United States Patent [19]

Campagna, Jr. et al.

[11] 3,979,976

[45] Sept. 14, 1976

[54] RING EXPANDER DEVICE

[75] Inventors: Samuel A. Campagna, Jr., Deptford, N.J.; Benjamin J. Campagna, Newark, Del.

[73] Assignee: Benjamin J. Campagna, Newark, Del.

[22] Filed: Oct. 22, 1975

[21] Appl. No.: 624,948

[52] U.S. Cl. ..... 81/3 R; 29/244
[51] Int. Cl.[2] ..... B25B 13/54
[58] Field of Search ..... 29/244, 283, 200 R; 81/3 R, 72; 52/20

[56] References Cited

UNITED STATES PATENTS 3,798,848 3/1974 Campagna ..... 52/20

*Primary Examiner*—Al Lawrence Smith
*Assistant Examiner*—Roscoe V. Parker
*Attorney, Agent, or Firm*—Connolly and Hutz

[57] ABSTRACT

Device for expanding ring-like support to increase diameter thereof comprises flexible expander band having overlapping end portions and forming closed loop of variable diameter. Expander band is positioned within ring-like support and functions to expand support. Motivating structure is fixed to one of overlapping end portions of flexible expander band and has rotatable pinion gear connected thereto. Gear rack is associated with other overlapping end portion of flexible expander band for movement therewith. Gear rack is in meshing engagement with rotatable pinion gear so that rotation of pinion gear shifts overlapping end portions of flexible expander band relative to one another to increase diameter of closed loop formed thereby.

10 Claims, 8 Drawing Figures

RING EXPANDER DEVICE

CROSS-REFERENCE TO RELATED APPLICATIONS

The present application relates to U.S. Pat. No. 3,712,009, granted Jan. 23, 1973, U.S. Pat. No. 3,798,848, granted Mar. 26, 1974, and Application Ser. No. 524,537, filed Nov. 18, 1974.

BACKGROUND OF THE INVENTION

The present invention relates to a ring expander device, and more particularly to a device for expanding a ring-like support to increase the diameter thereof.

It is desirable to segregate sanitary or sewerage systems from those systems designed to handle storm and drainage water since such segregation reduces an unnecessary burden on the sewerage treatment facility. Obviously, when drainage and storm water empties into a sanitary system the sewerage treatment plant must necessarily handle and treat the storm water in addition to the sewerage material. Standard frames and covers for manholes that lead to sanitary or sewerage systems generally include heavy cover constructions with passageways therein that serve to vent the overall system for the purpose of relieving internal pressure as well as vacuum build-ups. The passageways in these manhole covers also enable storm water to empty into the sewerage system. It is impossible to simply seal off or otherwise eliminate the cover passageways since pressure developed within the sewerage system could easily produce a force sufficient to blow the cover away from its seated position at the manhole opening or blast the plugs away from the passageways. Additionally, pressure developed within the sewerage system can easily cause damage to the system if that pressure is not relieved.

Application Ser. No. 524,537, filed Nov. 18, 1974, describes a support ring for mounting a manhole closure assembly within a manhole opening. When installed the closure assembly functions to prevent storm water from entering the manhole and also relieves internal pressure therein when it exceeds a predetermined amount. The description of the support ring together with the remaining specification of the above application is herewith incorporated in the present application.

While most manholes include openings surrounded by an annular manhole frame that includes several inwardly directed flanges, a significant number of manhole frames do not include an appropriate flange for supporting the manhole closure assembly. The absence of such flange structure on the manhole frame necessitates a separate support for the closure assembly. The device of the present invention is used to expand the support ring into position within a manhole opening where it serves as a mounting for the closure.

SUMMARY OF THE INVENTION

The primary object of the present invention is to provide an efficient and economical arrangement for expanding a ring-like support so as to increase its diameter.

In accordance with the present invention, a device is provided for expanding a ring-like support to increase the diameter thereof. The device comprises a flexible expander band having overlapping end portions and forming a closed loop of variable diameter adapted to be positioned within a ring-like support to be expanded. Motivating structure is fixed to one of the overlapping end portions of the flexible expander band and this structure includes a rotatable pinion gear. A gear rack is associated with the other overlapping end portion of the flexible expander band for movement therewith. The gear rack is in meshing engagement with the rotatable pinion gear so that rotation of the pinion gear shifts the overlapping end portions of the flexible expander band relative to one another to increase the diameter of the closed loop formed thereby.

The gear rack may comprise a separate piece fixed to the flexible expander band for movement with the other overlapping end portion thereof. Also, the motivating structure may include a driven gear in meshing engagement with the pinion gear and an operator shaft connected to rotate the driven gear. The motivating structure further includes a housing with handles secured thereto for manipulating the expander device.

Preferably, the ring expander device of the present invention includes a ratchet in engagement with the pinion gear for preventing rotation thereof in a direction opposite to the one that increases the diameter of the closed loop formed by the flexible expander band. Moreover, a releasable detent is next to the ratchet where it is arranged to releasably maintain the ratchet out of engagement with the pinion gear so that the closed loop formed by the flexible expander band is free to contract.

The ring expander device may be used in combination with a movable stand having an elevator associated therewith for up and down movement relative to the stand. Structure is provided for connecting the expander device to the elevator. Moreover, the movable stand may include a plurality of externally threaded upright shafts. The elevator may then include a plurality of planet gears, one centrally threadably received on each shaft, a rotatable sun gear in meshing engagement with the external surface of each planet gear, and a motivator for rotating the sun gear which in turn rotates the planet gears to thereby adjust the elevation of the device relative to the movable stand. Finally, a power unit may be connected to rotate the pinion gear of the motivating structure for the expander device and the sun gear of the elevator.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figure 2:
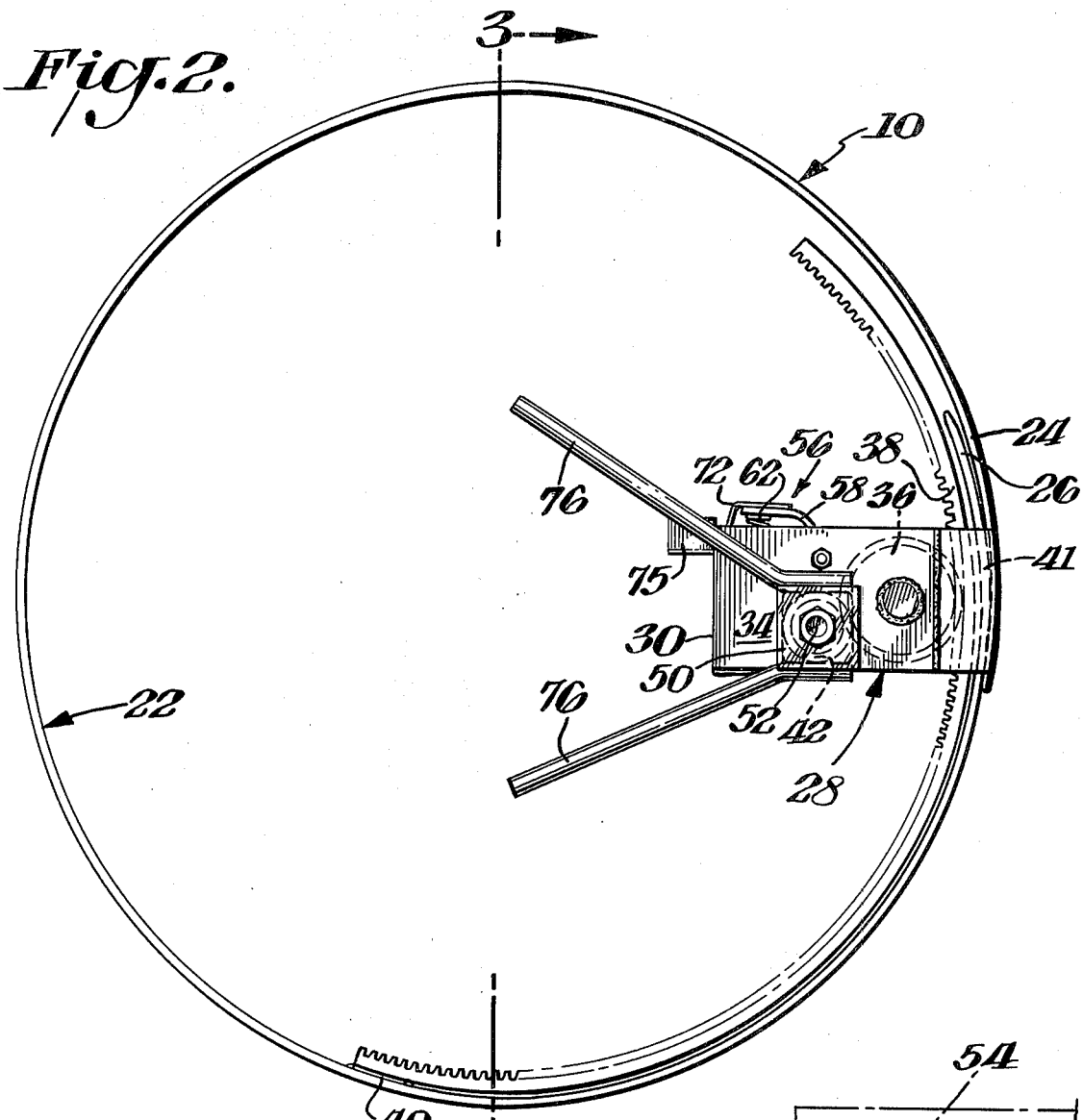
FIG. 2 is a top plan view of the ring expander device shown in FIG. 1.

Referring in more particularity to the drawing, FIGS. 1–5 illustrate a device 10 for expanding a ring-like support 12 to increase the diameter thereof. As explained in Application Ser. No. 524,537, filed Nov. 18, 1974, the ring-like support 12 may comprise a two-piece arrangement connected together in end-to-end fashion by a weld, for example, and the free end of one of the pieces 14 is designed to telescope into the free end of the other piece 16. The ring 12 is expanded into position within a manhole opening 18 until a strip of resilient material 20 secured to the exterior of the ring is sufficiently compressed and the ring is placed in compression. The telescoping portions of the ring pieces 14, 16 are then connected together by suitable fastening devices, such as rivets, for example. As explained more fully below, the ring expander device 10 may then be removed which completes the installation procedure.

The device 10 primarily includes a flexible expander band 22 fabricated of metal and having overlapping end portions 24, 26. The overall band 22 forms a closed loop of variable diameter, and the band 22 is adapted to be positioned within the ring-like support 12 to be expanded.

Figure 4:
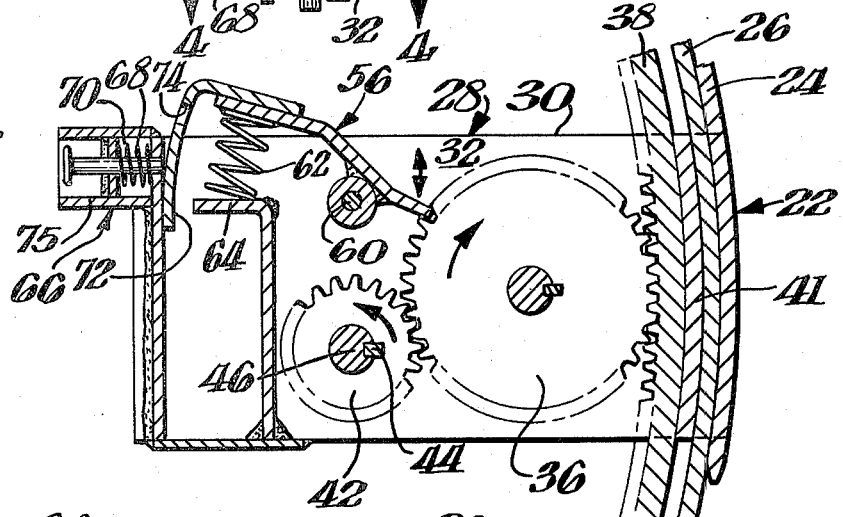
FIG. 4 is a sectional view taken along line 4—4 of FIG. 3.

Motivating structure generally identified by reference numeral 28 is provided for shifting the overlapping end portions 24, 26 of the flexible expander band 22 relative to one another. Such shifting either increases or decreases the diameter of the closed loop formed by the band 22 depending upon the directional movement of the various mechanisms that comprise the motivating structure. As shown best in FIG. 4, the motivating structure includes a relatively flat housing 30 formed by spaced apart upper and lower plates 32, 34. A rotatable pinion gear 36 is mounted within the housing 30 and the teeth thereof are in meshing engagement with a gear rack 38 associated with the overlapping end portion 26 of the flexible expander band 22. The gear rack comprises a separate piece fixed to the flexible expander band by a weld 40 for movement with the overlapping end portion 26 of the band. The other overlapping end portion 24 is permanently fixed to the housing 30, and as shown in FIG. 4, a spacer bar 41 separates the gear rack 38 from the overlapping end portions of the expander band 22.

Continuing, the motivating structure 28 includes a driven gear 42 in meshing engagement with the pinion gear 36. The driven gear 42 is keyed at 44 to an operator shaft 46 connected to rotate the driven gear. In this regard, the operator shaft 46 extends outwardly into an elongate housing 48 welded to the flat housing 30. The shaft extends outwardly through the top 50 of the elongate housing; and the free end thereof carries a hex nut 52. Rotation of the hex nut through manipulation of a suitable tool 54 causes the driven gear 42 to rotate. Both gears are sandwiched between the upper and lower plates 32, 34 of the flat housing 30, and rotation of the driven gear 42 causes the pinion gear 36 to rotate which in turn shifts the gear rack 38 in one direction or the other depending upon the direction of rotation of the driven gear.

The housing 30 of the motivating structure 28 also carries a ratchet arrangement 56 in engagement with the pinion gear for preventing rotation thereof in a direction opposite to the one that increases the diameter of the closed loop formed by the flexible expander band 22. The ratchet arrangement 56 includes a pawl 58 pivotally mounted between the plates 32, 34 by a pin 60. A coil spring 62 reacts between the free end of the pawl and mounting structure 64 and the spring urges the tip of the pawl into engagement with the teeth on the pinion gear 36. Hence, the ratchet device 56 allows the pinion gear to rotate in clockwise direction, as viewed in FIG. 4, which in turn expands the band 22. Counterclockwise rotation of the pinion gear 36 is prevented by the ratchet arrangement 56.

Figure 5:
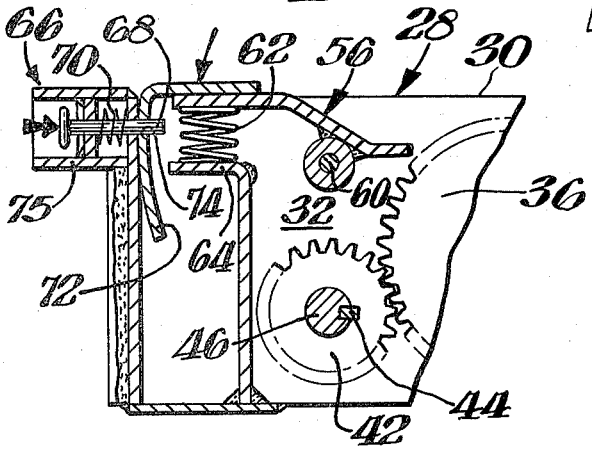
FIG. 5 is a sectional view similar to FIG. 4 illustrating the ratchet in its inoperative position.

Detent structure 66 is located next to the ratchet arrangement 56 for releasably maintaining the pawl 58 out of engagement with the pinion gear 36, as shown best in FIG. 5. Such positioning enables the closed loop formed by the flexible expander band 22 to contract since the pinion gear 36 is allowed to rotate in a counterclockwise direction. The detent structure 66 includes a pin 68 biased in an outward direction by coil spring 70. Moreover, the free end of the pawl 58 opposite the gear engaging end includes an L-shaped piece 72 with an opening 74 therein into which the spring biased pin 68 may be inserted. The ratchet arrangement 56 is maintained out of engagement with the pinion gear 36 by urging the L-shaped piece 72 in the direction of the arrow shown in FIG. 5 against the force of the coil spring 62 until the opening 74 is in alignment with the spring biased pin 68. The end of the pin 68 is then urged in the direction of the arrow against the force of spring 70 until the pin enters the opening 74. The pressure on the L-shaped piece 72 is then released, and the pin 68 prevents return of the ratchet to its operative position. Frictional engagement between the end of the spring biased pin 68 and the L-shaped piece 72 aids in maintaining the ratchet inoperative. The detent structure 66 may be released by simply applying pressure to the L-shaped piece 72 in the direction of the arrow which allows the spring 70 to withdraw the pin 68. The ratchet arrangement then moves to its operative position under the force of the coil spring 62. Accidental activation of the detent structure is prevented by the protective shield 75.

Handles 76 are secured to the elongate housing 48 of the motivating structure 28, and these handles may be used to manipulate and support the ring expander device 10 during the installation procedure.

Figure 1:
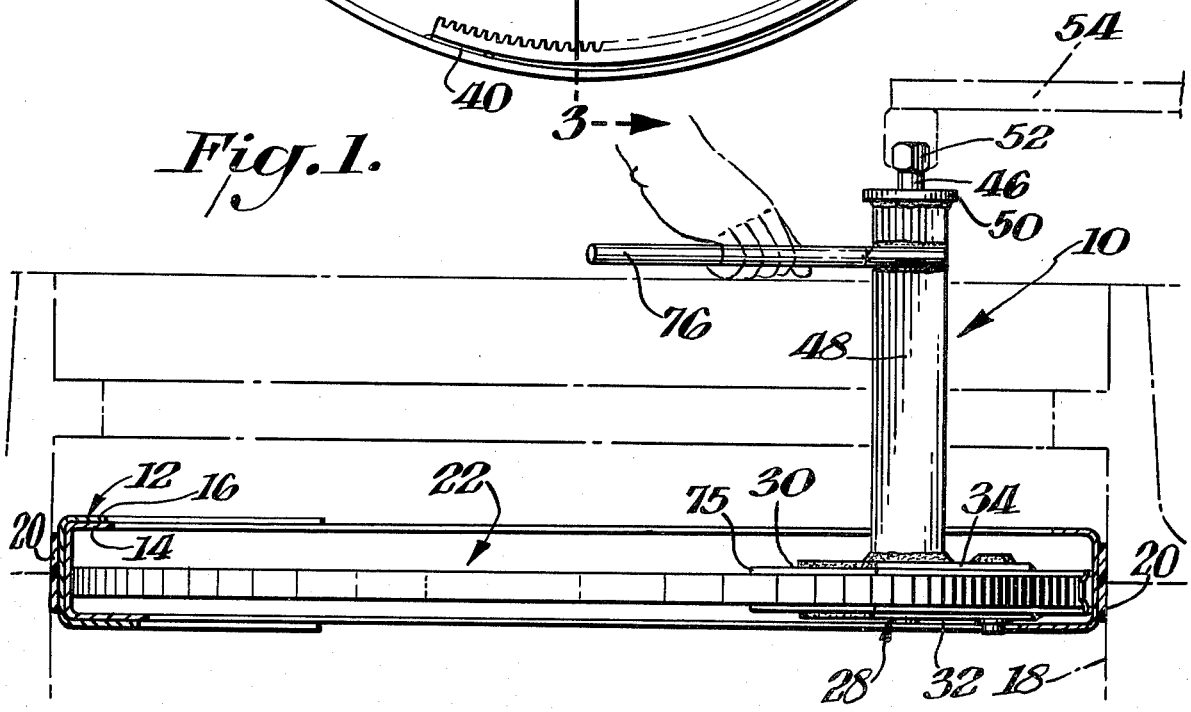
FIG. 1 is a side elevational view of a ring expander device according to the present invention illustrating the manner in which the device is used to expand a ring-like support into position.
Figure 3:
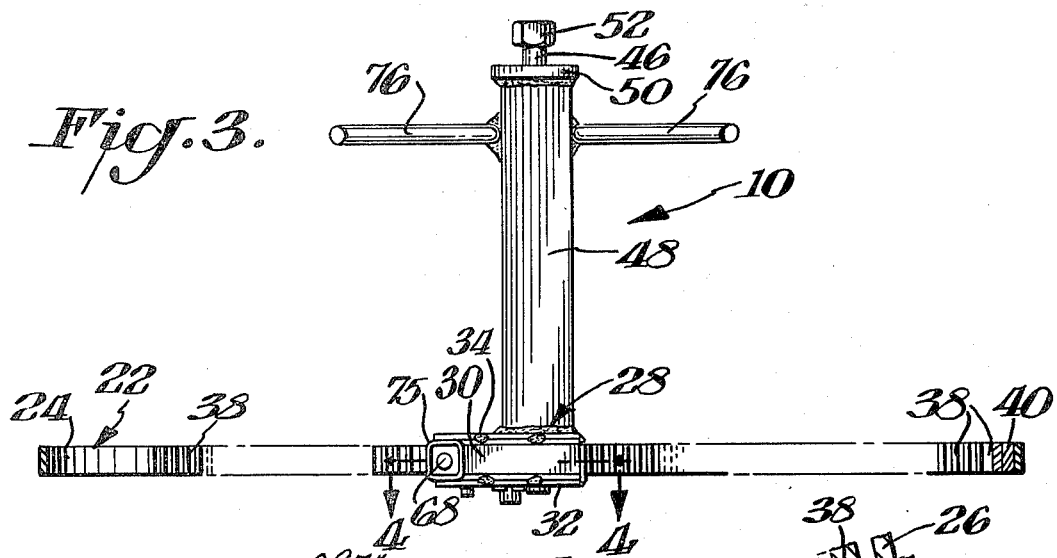
FIG. 3 is a sectional view taken along line 3—3 of FIG. 2.

In operation, the device 10 and support ring 12 are positioned within the manhole opening 18, as best shown in FIG. 1. The ratchet arrangement 56 is operatively positioned as shown in FIG. 4, and the driven gear 42 is then rotated by manipulating the tool 54. As noted above, the tool connects to the hex nut 52 on the operator shaft 46 for the driven gear 42. The driven gear rotates the pinion gear 36 which in turn causes the gear rack 38 to shift the overlapping end portions 24, 26 of the expander band 22 away from each other. Such movement increases the diameter of the closed loop formed by the expander band. Reverse movement is prevented by the ratchet arrangement 56.

After the support ring 12 is sufficiently compressed, the telescoping portions thereof are secured together, as described above. The ring expander device 10 is then removed by first engaging the detent structure 66 so that it maintains the ratchet arrangement 56 out of engagement with the pinion gear 36. The gear rack 38 is then free to reverse its shifting movement which causes the closed loop formed by the band 22 to decrease in size. The device 10 is then removed from within the ring support 12 to thereby complete the installation procedure.

Figure 6:
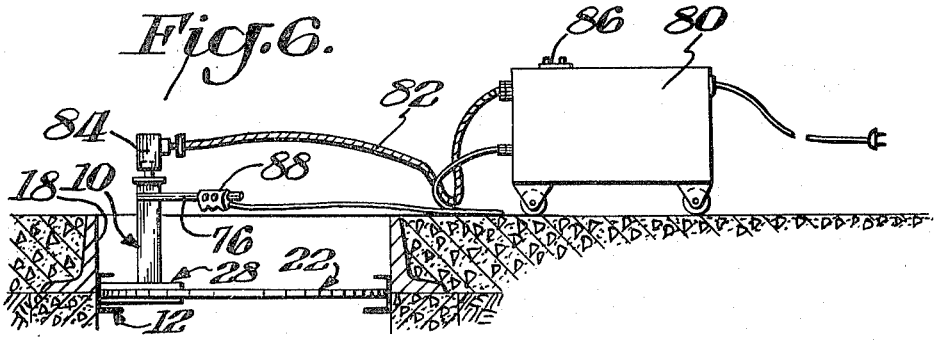
FIG. 6 diagrammatically illustrates a power unit for manipulating the ring expander device according to the present invention.

FIG. 6 illustrates a slightly modified embodiment of the present invention wherein a suitable power unit 80 is utilized to rotate the operator shaft 46 connected to the driven gear 42. The power unit 80 includes a flexible transmission 82 and a connector head 84 which fastens onto the hex nut 52 of the operator shaft. Dual controls may be provided with one of the controls 86 located on the power unit and a remote control 88 located on the handle structure 76. While the power unit 80 is shown as being electrically energized, other power sources are equally suitable. With the exception of the power unit 80, the arrangement shown in FIG. 6 operates the same manner as described above.

Figure 7:
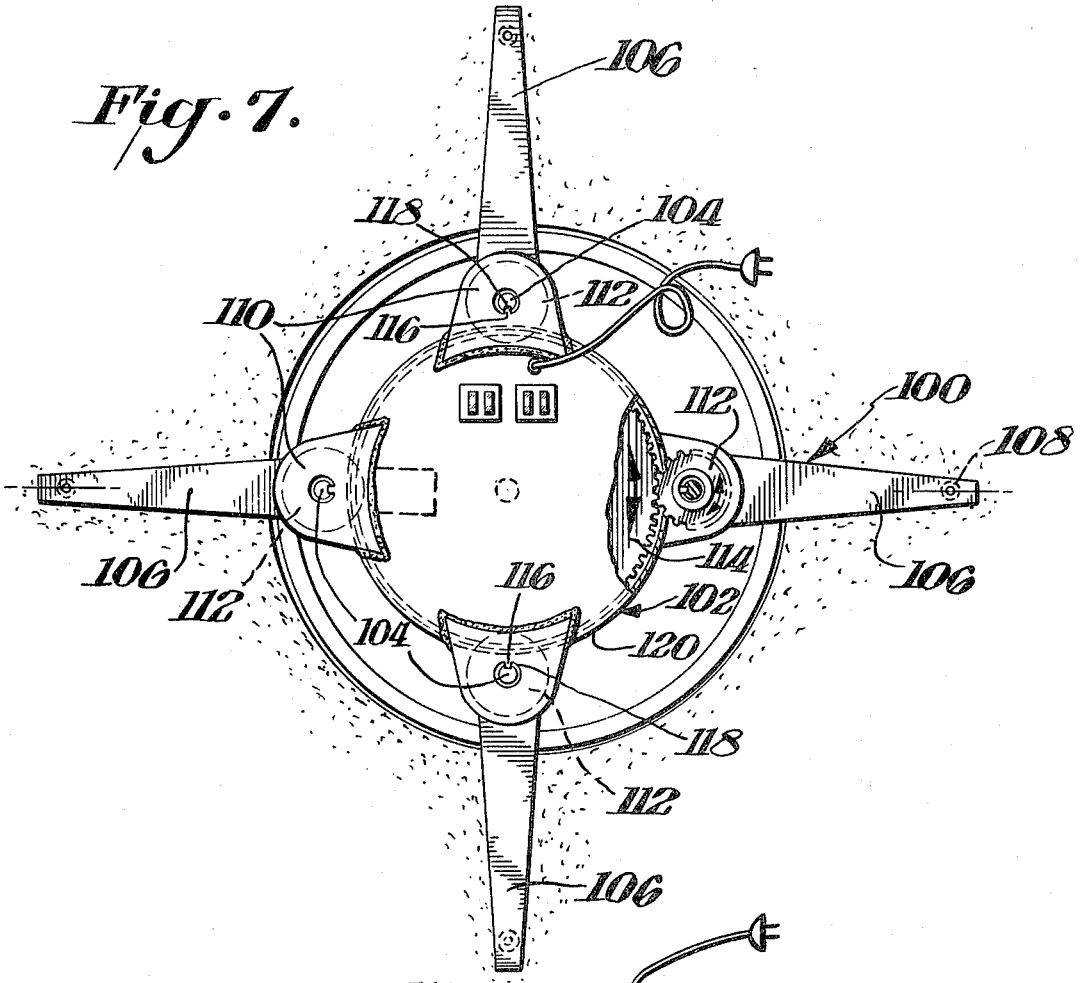
FIG. 7 is a top plan view of the combination of a ring expander device, a movable stand and an elevator, according to the present invention.
Figure 8:
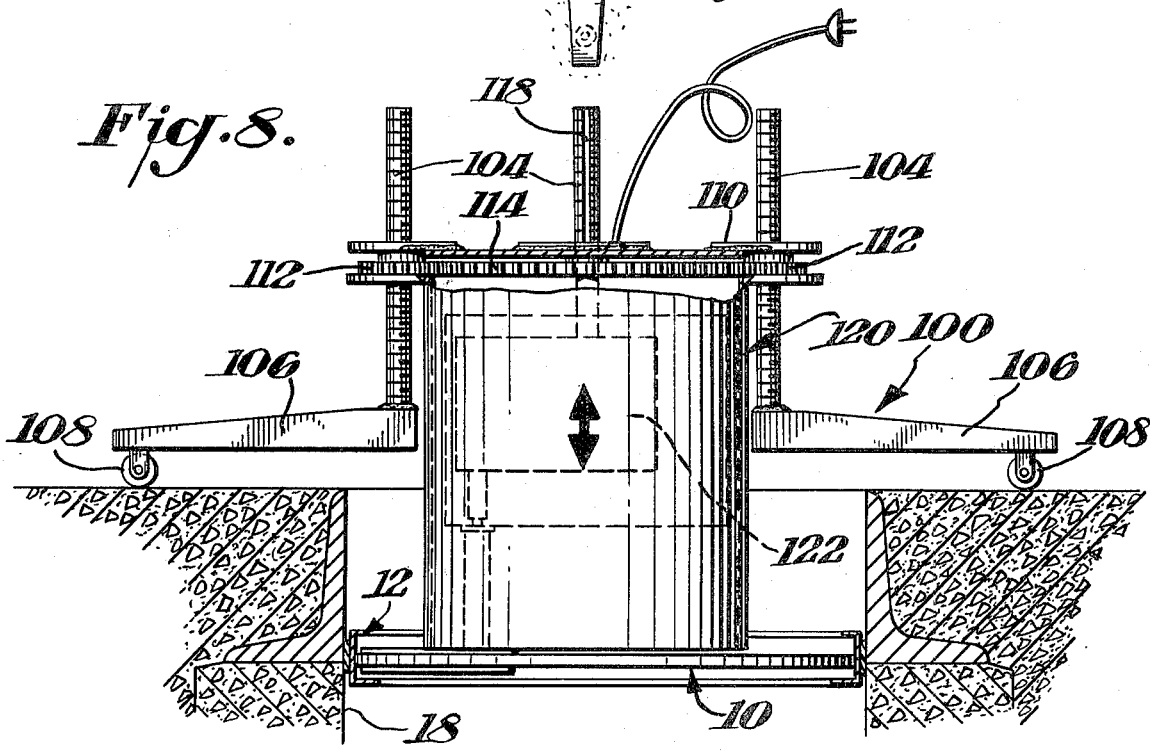
FIG. 8 is a sectional view taken along line 8—8 of FIG. 7.

FIGS. 7 and 8 illustrate the ring expander device 10 in combination with a movable stand 100 and an elevator arrangement 102. The movable stand 100 comprises four externally threaded upright shafts 104 and each shaft is fixed to a leg base 106 having a swivel caster 108 at the outer end thereof. Each swivel caster may be provided with a brake, if desired.

The elevator arrangement 102 comprises a suitable framework 110 for mounting an array of gears. This array includes a plurality of planet gears 112, one centrally threadably received on each upright shaft 104 of the movable stand 100. The gear array also includes a centrally disposed rotatable sun gear 114 in meshing engagement with the external surface of each planet gear. As explained more fully below, as the sun gear 114 rotates the individual planet gears 112 also rotate which causes the elevator arrangement 102 to ride up and down on the externally threaded upright shafts 104 of the movable stand 100. The elevator framework 110 may include tabs 116 that extend into longitudinal keyways 118 on each of the upright shafts 104 to prevent relative rotational movement of the stand 100 and the elevator framework.

The expander device 10 is generally identical to the devices illustrated in FIGS. 1–5, and it is suspended from the elevator framework 110 by a housing 120 which interconnects the device 10 with the framework 110. The housing 120 carries a suitable power and transmission unit 122 connected to rotate both the sun gear 114 of the elevator arrangement 102 as well as the operator shaft 46 of the expander device 10.

In operation, the elevator arrangement 102 is initially positioned so that the planet gears 112 thereof close to the top of each of the threaded upright shafts 104 of the movable stand 100. The support ring 12 to be expanded and the ring expander device 10 are then assembled and positioned directly under the movable stand 100. The entire combination is then wheeled into position over the manhole 18 in which the support ring is to be located. The power and transmission unit 122 is then energized so that the central sun gear 114 rotates in a direction which causes the elevator to travel in a downward direction thereby lowering the device 10 and ring 12 into the manhole 18. The elevator is then deenergized and the power unit is utilized to rotate the operator shaft 46 to expand the device 10. Otherwise, the procedure is similar to that described above. Ultimately, the elevator arrangement 102 lifts the device 10 out of the manhole and the entire combination may be wheeled away.

What is claimed is:

1. A device for expanding a ring-like support to increase the diameter thereof comprising a flexible expander band having overlapping end portions and forming a closed loop of variable diameter adapted to be positioned within a ring-like support to be expanded, motivating means fixed to one of the overlapping end portions of the flexible expander band and having a rotatable pinion gear, a gear rack associated with the other overlapping end portion of the flexible expander band for movement therewith and in meshing engagement with the rotatable pinion gear whereby rotation of the pinion gear shifts the overlapping end portions of the flexible expander band relative to one another to increase the diameter of the closed loop formed thereby.

2. A device as in claim 1 wherein the gear rack comprises a separate piece fixed to the flexible expander band for movement with the other overlapping end portion thereof.

3. A device as in claim 1 wherein the motivating means includes a driven gear in meshing engagement with the pinion gear and an operator shaft connected to rotate the driven gear.

4. A device as in claim 1 including a ratchet in engagement with the pinion gear for preventing rotation thereof in a direction opposite to the one that increases the diameter of the closed loop formed by the flexible expander band.

5. A device as in claim 4 including a releasable detent next to the ratchet and arranged to releasably maintain the ratchet out of engagement with the pinion gear whereby the closed loop formed by the flexible expander band is free to contract.

6. A device as in claim 1 wherein the motivating means includes a housing with handle structure secured thereto for manipulating the expander device.

7. A device as in claim 1 including a power unit connected to rotate the pinion gear.

8. A device as in claim 1 in combination with a movable stand having an elevator associated therewith for up and down movement relative to the stand, and means connecting the device to the elevator.

9. A combination as in claim 8 wherein the movable stand includes a plurality of externally threaded upright shafts, and wherein the elevator includes a plurality of planet gears, one centrally threadably received on each shaft, a rotatable sun gear in meshing engagement with the external surface of each planet gear, and means for rotating the sun gear which in turn rotates the planet gears to thereby adjust the elevation of the device relative to the movable stand.

10. A combination as in claim 9 including a power unit connected to rotate the pinion gear of the device and the sun gear of the elevator.

* * * * *